US009160104B2

(12) United States Patent
Neumeuer et al.

(10) Patent No.: US 9,160,104 B2
(45) Date of Patent: Oct. 13, 2015

(54) PLUG-IN CONNECTOR AND A PLUG-IN MODULE SYSTEM

(75) Inventors: Horst Neumeuer, Bad-Konig (DE); Ralf Hecker, Buerstadt (DE); Alfons Ketteler, Darmstadt (DE); Dieter Lietz, Jugendheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 140 days.

(21) Appl. No.: 13/698,571

(22) PCT Filed: May 12, 2011

(86) PCT No.: PCT/EP2011/057659

§ 371 (c)(1), (2), (4) Date: Nov. 16, 2012

(87) PCT Pub. No.: WO2011/144514

PCT Pub. Date: Nov. 24, 2011

(65) Prior Publication Data

US 2013/0059481 A1 Mar. 7, 2013

(30) Foreign Application Priority Data

May 20, 2010 (DE) ..... 10 2010 029 192

(51) Int. Cl.

*H01R 4/48* (2006.01)
*H01R 13/627* (2006.01)
*H01R 13/432* (2006.01)
(Continued)

(52) U.S. Cl.

CPC ..... *H01R 13/6272* (2013.01); *H01R 13/432* (2013.01); *H01R 13/506* (2013.01); *H01R 13/642* (2013.01); *H01R 13/4361* (2013.01)

(58) Field of Classification Search

CPC .... H01R 13/111; H01R 13/18; H01R 13/432; H01R 13/4362

USPC ..... 439/746–749, 752, 839, 843, 846, 851

See application file for complete search history.

(56) References Cited

U.S. PATENT DOCUMENTS 995,674 A * 6/1911 Hertzberg ..... 439/687
3,555,496 A * 1/1971 Pearce, Jr. et al. ..... 439/748
(Continued)

FOREIGN PATENT DOCUMENTS

DE 35 37 722 A1 4/1987
DE 19651120 C1 5/1998
(Continued)

OTHER PUBLICATIONS

International Search Report and Written Opinion issued by the European Patent Office, dated Sep. 7, 2011, for related International Application No. PCT/EP2011/057659; 14 pages.
(Continued)

*Primary Examiner* — Thanh Tam Le
(74) *Attorney, Agent, or Firm* — Faegre Baker Daniels LLP

(57) ABSTRACT

The invention relates to a plug-in connector (1) and a plug-in module system having a first contact casing (10) with a first receptacle (14) and a second contact casing (7) with a second receptacle (8), the first receptacle (14) being designed to receive a socket contact (12) and the second receptacle (8) being designed to receive a plug contact (13), the first receptacle (14) and the second receptacle (8) being formed identically.

24 Claims, 11 Drawing Sheets

(51) Int. Cl.

| | |
|---|---|
| ***H01R 13/506*** | (2006.01) |
| ***H01R 13/642*** | (2006.01) |
| *H01R 13/436* | (2006.01) |

(56) References Cited

U.S. PATENT DOCUMENTS

| | | | | | |
|---|---|---|---|---|---|
| 3,789,343 | A | * | 1/1974 | Hirokawa et al. | 439/291 |
| 4,083,617 | A | * | 4/1978 | Wyatt | 439/295 |
| 5,573,432 | A | | 11/1996 | Hatagishi | |
| 5,695,368 | A | * | 12/1997 | Joly et al. | 439/748 |
| 5,954,548 | A | * | 9/1999 | Stabroth | 439/839 |
| 5,967,842 | A | | 10/1999 | Okabe | |
| 6,109,982 | A | * | 8/2000 | Okabe et al. | 439/748 |
| 6,126,495 | A | * | 10/2000 | Lolic et al. | 439/839 |
| 6,186,837 | B1 | * | 2/2001 | Abe | 439/748 |
| 6,267,616 | B1 | * | 7/2001 | Sakatani et al. | 439/397 |
| 7,390,225 | B2 | * | 6/2008 | Elku et al. | 439/660 |

FOREIGN PATENT DOCUMENTS

| | | | |
|---|---|---|---|
| DE | 19739503 | A1 | 3/1999 |
| DE | 299 07 495 | U1 | 9/1999 |
| DE | 10352403 | A1 | 6/2004 |
| DE | 102007063207 | | 6/2009 |
| EP | 0822616 | A2 | 2/1998 |
| EP | 1786068 | A1 | 5/2007 |
| WO | WO 2005107020 | A1 | 11/2005 |
| WO | WO 2010041823 | A2 | 4/2010 |

OTHER PUBLICATIONS

Search Report issued by the German Patent and Trademark Office, dated Mar. 22, 2011, for German priority Application No. 10 2010 029 192.7; 20 pages.

* cited by examiner

PLUG-IN CONNECTOR AND A PLUG-IN MODULE SYSTEM

BACKGROUND

The invention relates to a plug-in connector and a plug-in module system having a first contact casing with a first receptacle and a second contact casing with a second receptacle, the first receptacle being designed to receive a socket contact and the second receptacle being designed to receive a plug contact.

A plug-in connector is known from U.S. Pat. No. 3,686,619 which comprises a first contact casing with a receptacle for a plug contact and a second contact casing with a second receptacle for a socket contact. Therein, the first contact casing is designed to engage around the second contact casing in parts, with the plug contact penetrating into the socket contact upon pushing the first contact casing on to the second contact casing. The first receptacle in this case is configured such that it offers the plug contact optimum holding in the first contact casing. Likewise, the second receptacle is adapted to the socket contact.

SUMMARY

It is an object of the invention to provide an improved and simply extended plug-in connector and an improved plug-in module system.

This object is achieved by a plug-in connector according to Claim 1. Preferred embodiments of the invention are set forth in the dependent claims.

It was recognised according to the invention that an improved plug-in connector can be made available by the plug-in connector comprising a first contact casing with a first receptacle and a second contact casing with a second receptacle, the first receptacle being designed to receive a socket contact and the second receptacle being designed to receive a plug contact, the first receptacle and the second receptacle being formed identically.

This has the advantage that the production of the plug-in connector can take place inexpensively and in simple manner in that only one mould is necessary for forming the receptacles.

In a further embodiment of the invention, the receptacles have in each case a recess which is provided to receive in each case a latch arm of the socket contact or of the plug contact. In this manner, the socket contact and the plug contact can be fastened reliably in the receptacle.

In a further embodiment of the invention, the receptacles each have an opening. The opening comprises a funnel-shaped region which is oriented on the inside towards the socket contact or the plug contact. A sleeve of the socket contact and/or of the plug contact comprises a conical region which is associated with the funnel-shaped region of the opening. In this manner, the plug contact can be centred in simple manner in the receptacle upon insertion into the receptacle.

In a further embodiment of the invention, the opening has a further funnel-shaped region on the outside on the casing. In this manner, the introduction of a pin of the plug contact of the second contact casing into the first contact casing of the socket contact is facilitated, since the pin is guided directly onto the opening of the socket contact.

In a further embodiment of the invention, the first contact casing and the second contact casing are formed substantially identically. In this manner, a contact casing which can be produced inexpensively, which can be used both for socket contacts and for plug contacts, can be made available. Further, the contact casing can be produced in only one injection-moulding machine.

In a further embodiment of the invention, the contact casing has on an outer peripheral surface at least one groove which is designed to receive a protrusion of a casing holder. In this manner, the contact casing can be fastened simply and reliably to the casing holder.

In a further embodiment of the invention, the casing holder engages at least partially around the first or the second contact casing, the casing holder being designed to connect the first or the second contact casing to a connector casing. In such case, the casing holder may have a latching means on its periphery which engages in a latch receptacle of the connector casing. In this manner, the first or the second casing can be fastened reliably and simply to the connector casing by means of the casing holder.

In a further embodiment of the invention, the casing holder has a coding rib which is designed to engage in a coding recess of the connector casing. In this manner, the orientation of the casing holder in the connector casing can be specified in simple manner.

The invention can however also be achieved with a plug-in module system according to Claim 12. Preferred embodiments are set forth in the dependent claims.

It was also recognised according to the invention that an improved plug-in module system can be provided in that the plug-in module system comprises a plug-in connector and a first casing holder, the first casing holder being connected to a first contact casing of the plug-in connector, and the first casing holder being designed to fasten the first contact casing in a connector casing, and means being provided to fasten a second contact casing to the connector casing.

In this manner, a plug-in module system can be provided which can be produced simply and inexpensively.

In a further embodiment of the invention, the connector casing is designed in several parts, the connector casing comprising a connector casing part and a second casing holder, means being provided to connect the second casing holder to the connector casing part. In this manner, the moulds for the production of the second casing holder and the connector casing part can be designed in simple manner, so that the plug-in module system can be produced inexpensively.

In a further embodiment of the invention, the connection and/or the means comprises a tongue-and-groove connection and/or at least one compression rib and/or a latching means. In this manner, the individual components of the plug-in module system can be connected together simply and reliably.

In a further embodiment of the invention, the first casing holder has on its periphery a latch spring which is designed to engage in a recess of the connector casing and to connect the first casing holder to the connector casing. In this manner, the first contact casing can be fastened reliably and reversibly in the connector casing by means of the casing holder.

BRIEF DESCRIPTION OF THE DRAWINGS

The invention will be explained in greater detail below with reference to figures. Therein.

DETAILED DESCRIPTION

Figure 2:
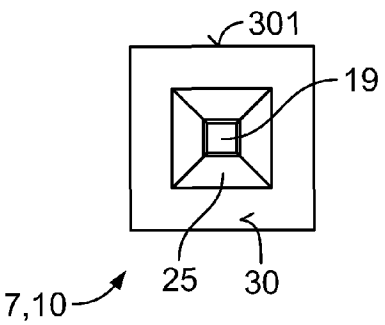
FIG. 2 shows a side view of the contact casing.
Figure 1:
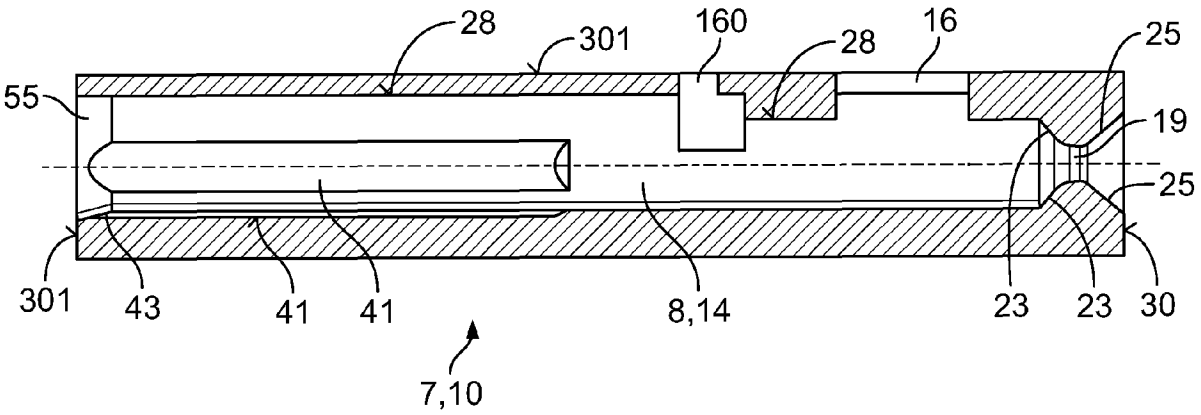
FIG. 1 shows a cross-section through a contact casing.

FIG. 1 shows a cross-section through a contact casing 7, 10, and FIG. 2 shows a side view of the contact casing 7, 10. The contact casing 7, 10 is elongate and rectangular in form, and has a receptacle 8, 14. The receptacle 8, 14 extends over the entire length of the contact casing 7, 10. The receptacle 8, 14 is substantially rectangular and comprises two openings 19, 55, which are arranged in each case on one end face 30, 300 of the contact casing 7, 10 and are oriented in the direction of the receptacle 8, 14.

Further, the receptacle 8, 14 comprises a first cuboid recess 16 which is oriented at right-angles to the receptacle 8, 14 and is opened towards its surroundings on a first side face 301 of the contact casing 7, 10. Further, a second cuboid recess 160 is arranged next to the first recess 16 on the same side face 301. A first opening 19, which is arranged on the right-hand side of the recess 16, comprises on the inside a first funnel-shaped region 23, which constricts the first opening 19. The first opening 19 has a second funnel-shaped region 25 on the outside on the contact casing 7, 10. A second opening 55 arranged on the left-hand side on the receptacle 8, 14 has a chamfer 43 which enlarges a cross-section of the second opening 55 relative to a cross-section of the receptacle 8, 14. Further, a cross-section of the receptacle 8, 14 is expanded by a further inner surface 41 in the form of part of a circle on the left-hand side in the receptacle 8, 14 on a first inner surface 28.

Figure 3:
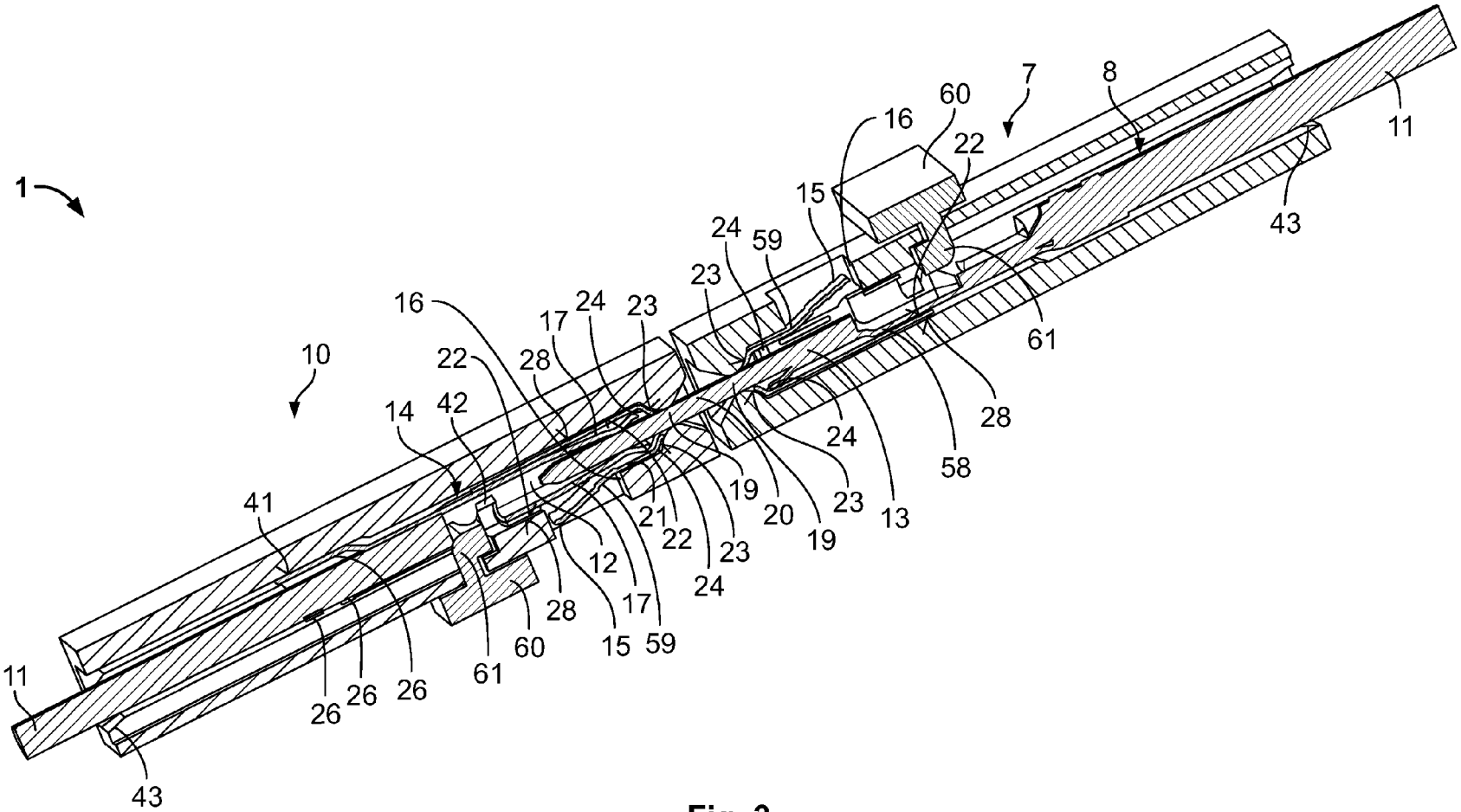
FIG. 3 shows a cross-section through a plug-in connector.

FIG. 3 shows a cross-section through a plug-in connector 1. The plug-in connector 1 comprises a first contact casing 10 and a second contact casing 7, which correspond in their configuration to the contact casing 7, 10 shown in FIG. 1 and FIG. 2. The first contact casing 10 in this case has a first receptacle 14 for receiving a socket contact 12. The second contact casing 7 has a second receptacle 8 for receiving a plug contact 13. The plug contact 13 is received completely by the second receptacle 8, is connected on the right-hand side to a cable 11 and has on the left-hand side a pin 20 which projects into the first contact casing 10.

The socket contact 12, which is connected on the left-hand side to a further cable 11, is arranged in the first receptacle 14 of the first contact casing 10. On the left hand side, the socket contact 12 has a sleeve 21 which forms an exterior of the socket contact 12. The socket contact 12 comprises on the inside of the sleeve 21 at least two contact arms 17 which lie opposite each other, the ends of the contact arm 17 being in the form of a nozzle in order to ensure reliable contact with the pin 20.

In the region of the contact arms 17, the sleeve 21 encompasses the female contact 12. The sleeve 21 in this case is connected with an edged point 42 to the socket contact 12. The sleeve 21 further has a latch arm 15 which projects into the first recess 16 of the first receptacle 14. In this manner it is ensured that the socket contact 12, coming from the left, can be pushed into the first receptacle 14, with pulling-out being prevented by the latch arm 15 and the projection into the recess 16. The sleeve 21 further comprises a conical region 24 which is arranged at the front end of the socket contact 12. The conical region 24 in this case is associated with the first funnel-shaped region 23 of the first receptacle 14, and is arranged at a distance from the funnel-shaped region 23. The distance is specified by the configuration of the latch arm 15 with a kink 59. The kink 59 in this case is arranged on the sleeve 21 such that the kink 59 touches a second side face 67 of the recess 16 upon insertion of the female contact 12 or of the contact plug 13 before the conical region 24 hits the first funnel-shaped region 23.

Centring of the socket contact 12 is further specified in the first receptacle 14 by a first peripheral surface 22 of the sleeve 21, the first peripheral surface 22 lying against a first inner surface 28 of the first receptacle 14. At the other end of the socket contact 12 from the contact arms 17, the cable 11 is connected to the socket contact 12 in electrically conductive manner by means of cable fixing points 26 on the socket contact 12. In this case, the cross-section of the first receptacle 14 in the region of the cable fixing points 26 is enlarged compared with a cross-section in the region of the contact arms 17, in order to be able to receive a cable cross-section of the cable 11 of sufficiently large dimensions in the first receptacle 14 on the socket contact 12. The chamfer 43 serves to facilitate the insertion of the socket contact 12 into the first receptacle 14.

The second contact casing 7 with a second receptacle 8 is arranged on the right-hand side of the first contact casing 10. The second receptacle 8 is formed identically to the first receptacle 14. The plug contact 13 is arranged in the second receptacle 8. The construction of the plug contact 13 is similar to that of the socket contact 12, the region of the contact arms 17 being replaced by a pin fastening 58 of the pin 20. The pin 20 in this case projects out of the second contact casing 7 into the first contact casing 10. The pin fastening 58 in this case is engaged around by the sleeve 21, the sleeve 21 likewise having the conical region 24. The first funnel-shaped region 23 has the advantage in the case of the plug contact 13 that the introduction of the pin 20 into the first opening 19 is facilitated in that the pin 20 is guided along the oblique funnel-shaped surfaces of the funnel-shaped region 23 towards the first opening 19. The cross-section of the first opening 19 in this case corresponds approximately to the cross-section of the pin 20. If the plug contact 13 is introduced completely into the second receptacle 8 upon assembly, the latch arm 15 of the sleeve 21 snaps into the recess 16 and prevents the plug contact 13 from being pushed back upon insertion of the pin 20 into the socket contact 12. The outer first peripheral surface 22 of the sleeve 21 likewise lies against the first inner surfaces 28 of the second receptacle 8. The second funnel-shaped region 25 of the first contact casing 10 facilitates the insertion of the pin 20 into the first opening 19 of the first contact casing 10, since the pin 20 is guided directly into the opening 19 via the oblique surfaces of the second funnel-shaped region 25, in order to construct an electrically conductive connection with the contact arms 17 of the socket contact 12.

The fastening of the two contact casings 7, 10 takes place by means of fastening hooks 60. The fastening hooks 60 have in the front end region a hook 61 which is oriented in the direction of the opposing contact casing 7, 10. In the assembled state, the hook 61 engages in the second recess 160 and thus prevents the contact casings 7, 10 from being able to be displaced in the direction of the receptacle. The contact casing 7, 10 is assembled in that the fastening hook 60 is pushed on to the contact casing 7, 10 transversely to the receptacle 8, 14. Further, the fastening hook 60 ensures additional locking for the socket contact 12 and the plug contact 13, since the hook 61 projects so far into the receptacle 8, 14 that pulling-out of the socket contact 12 or of the plug contact 13 is reliably prevented even in the event of a damaged latch arm 15. The assembly of the fastening hooks 60 further represents a check as to whether the plug contact 13 or the socket contact 12 is in its intended position, since otherwise an insufficiently inserted plug contact 13 or socket contact 12 is indicated by blocking upon pushing the fastening hook 60 on to the contact casing 7, 10.

Due to the substantially identical configuration of the first receptacle 14 of the first contact casing 10 and the second receptacle 8 of the second contact casing 7, the two contact casings 7, 10 and their receptacles 8, 14 can be manufactured from for example plastics material with the same injection mould in an injection-moulding process. In this case, the two receptacles 8, 14 are formed such that, depending on requirements, they can receive the socket contact 12 or the plug contact 13 without changing their configuration.

Figure 4:
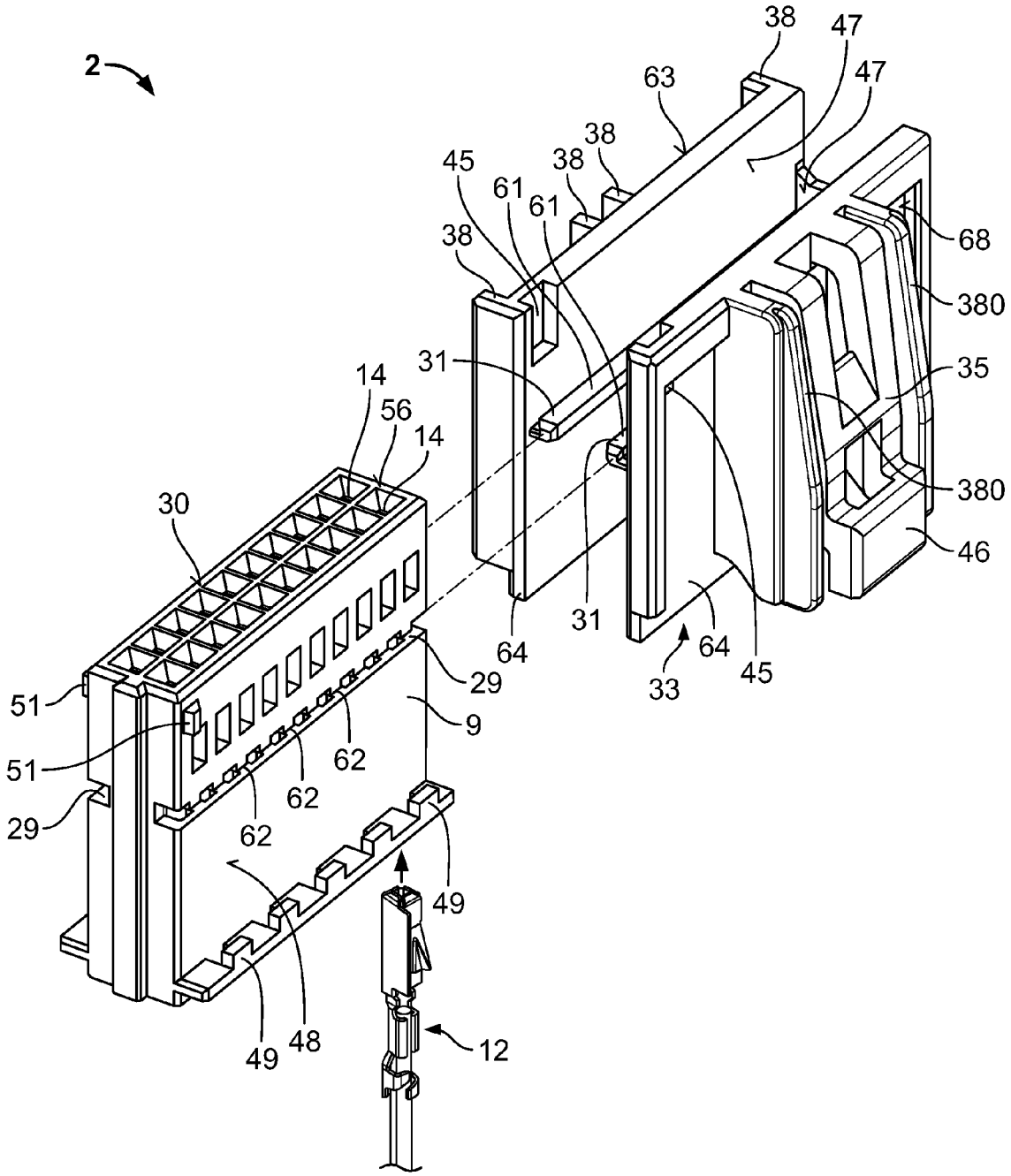
FIG. 4 shows an exploded view of a first module of a plug-in module system.
Figure 5:
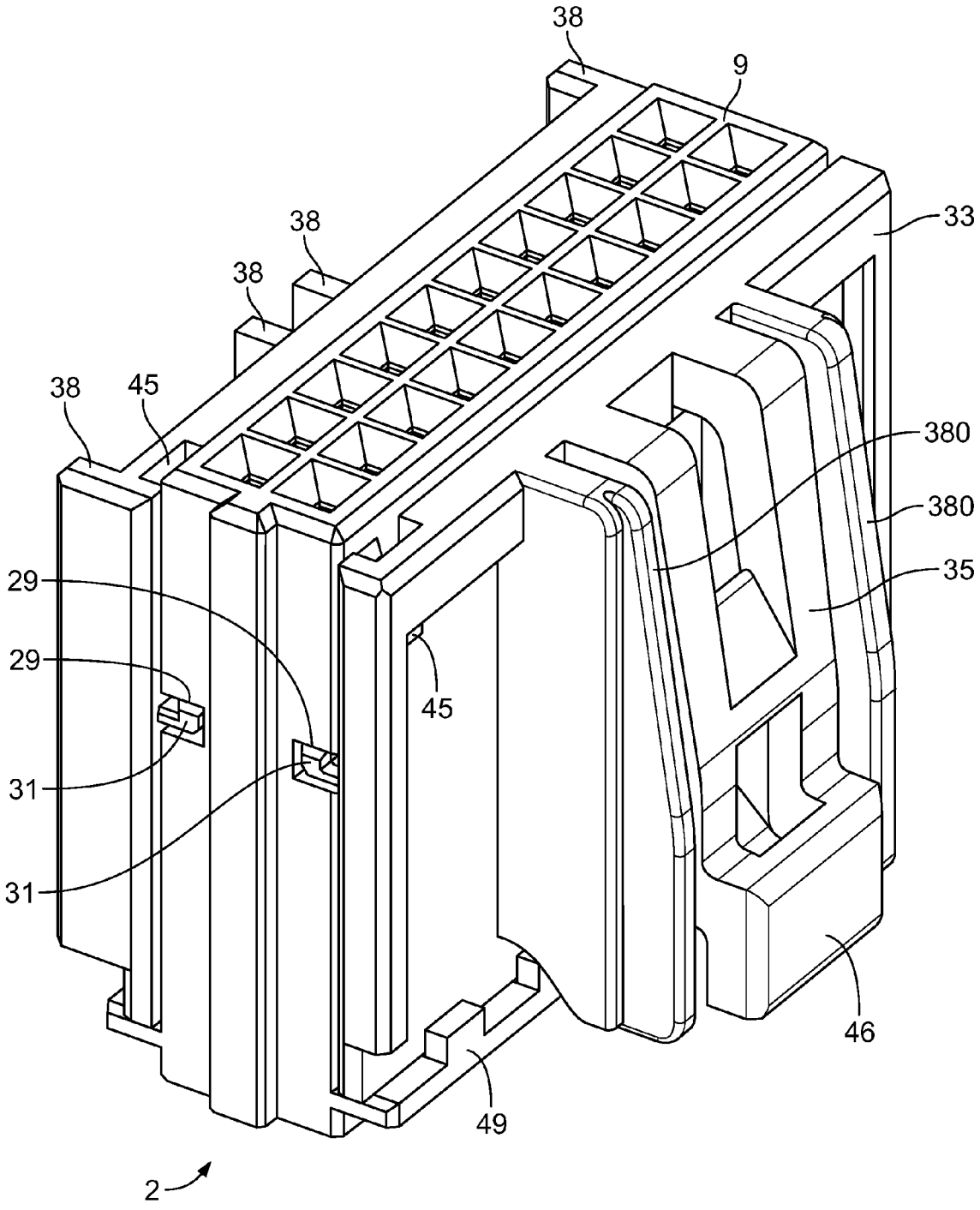
FIG. 5 shows a 3D representation of the first module in the assembled state.

FIG. 4 shows an exploded view of a first module 2 of a plug-in module system and FIG. 5 shows a 3D representation of the first module 2 in the assembled state. The module 2 comprises a first casing holder 33 and a third contact casing 9. The third contact casing 9 in this case comprises a plurality of first receptacles 14, as are shown in FIG. 1 and FIG. 3. The first receptacles 14 in this case are designed to receive the socket contact 12. The third contact casing 9 is approximately T-shaped. The upper end face 30 in this case corresponds to the end face 30 arranged on the right-hand side in FIG. 1. The T-piece of the third contact casing 9 in this case is arranged on the underside and comprises upward-oriented bars 49 which are arranged spaced apart from each other in the end region of the T-piece. On a second peripheral surface 48 of the third contact casing 9, a groove 29 is formed in the second peripheral surface 48 parallel to the end face 30. The groove 29 in this case extends transversely to the longitudinal direction of the first receptacle 14 and has an approximately L-shaped cross-section. The groove 29 is limited in this case by limiting bars 62 on the peripheral surface 48. In the upper region of the third contact casing 9, one latch projection 51 is arranged in each case at the left-hand side corners.

The first casing holder 33 has an approximately U-shaped configuration. In this case, a latch spring 35 with an actuating surface 46 is provided on an outer third peripheral surface 68 of the casing holder 33. The latch spring 35 is flanked by two coding ribs 38. The coding ribs 38 in this case extend parallel to the first receptacle 14 of the third contact casing 9. Further, the first casing holder 33 has on a rear side 63 further coding ribs 38 which are arranged in the edge region and centrally on the rear side 63 of the first casing holder 33. On a third inner surface 47 of the first casing holder 33 a protrusion 31 for a tongue-and-groove connection is arranged transversely to the longitudinal direction of the coding ribs 38. The protrusion 31 in this case, like the fastening hooks 61 shown in FIG. 1, has a hook 60 which is oriented upwards.

In order to assemble the first casing holder 33, it is pushed on to the third contact casing 9 in the direction of the arrow. In so doing, the protrusions 31 engage in the grooves 29 of the third contact casing 9 and guide it during assembly. If the first casing holder 33 has reached its end position, a right-hand side face 56 of the third contact casing 9 contacts the third inner surface 47 of the first casing holder 33. Further, the latch projections 51 latch in the latch receptacles 45 of the first contact holder 33. Due to the latching of the latching means 51, 45, the third contact casing 9 is secured against unintentional pushing out from the contact holder 33. Further, the upwards oriented bars 49 engage around a lower end 64 of the first casing holder 33, so that the first casing holder 33 is connected reliably to the third contact casing 9 in the lower region as well. The socket contacts 12 can be introduced into the third contact casing 9 before the assembly of the first casing holder 33 on the third contact casing 9. Alternatively, instead of the socket contacts 12 the plug contacts 13 can also be introduced into the same third contact casing 9, since the receptacles 14, 8 are formed substantially identically.

Figure 6:
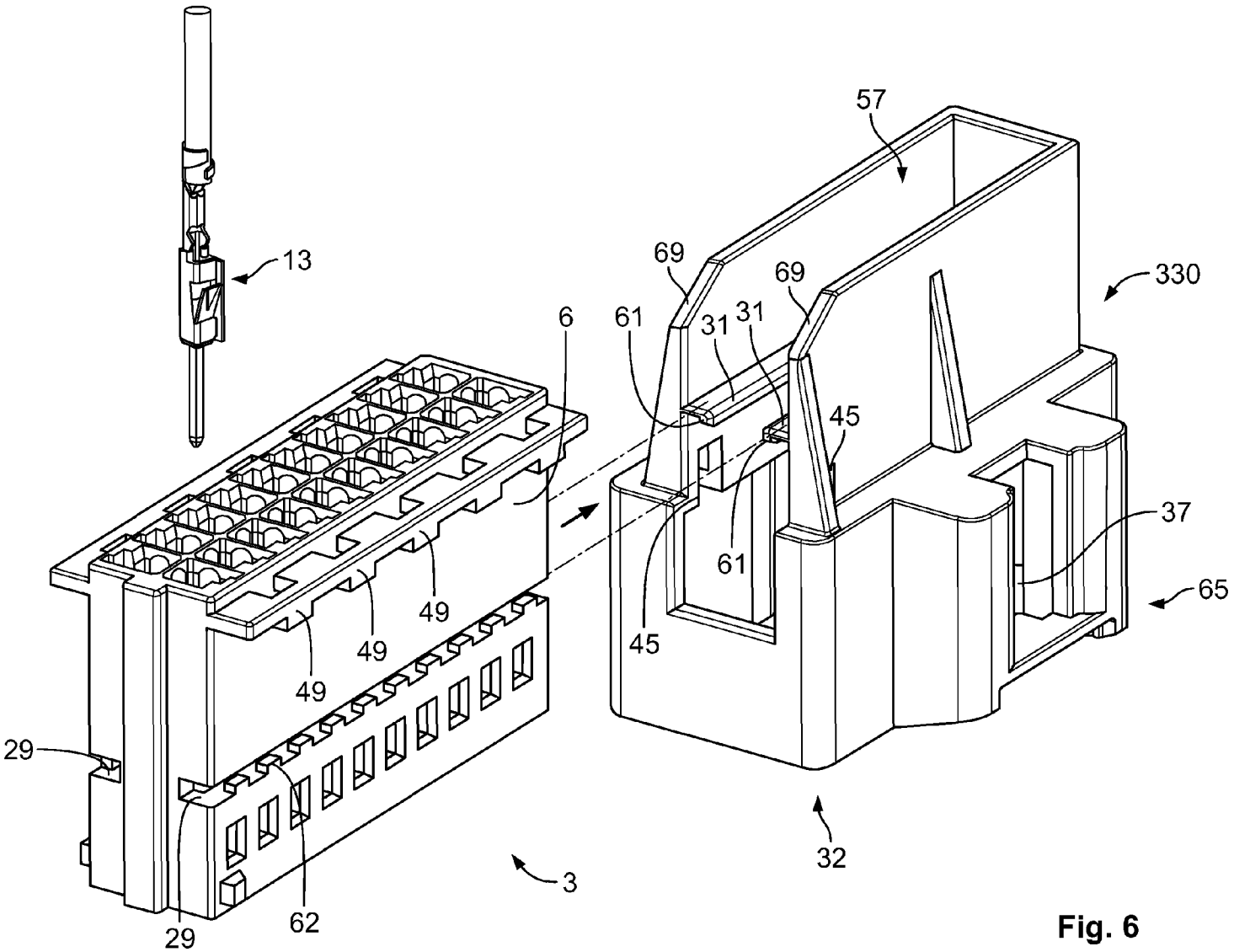
FIG. 6 shows an exploded view of a second module of the plug-in module system.
Figure 7:
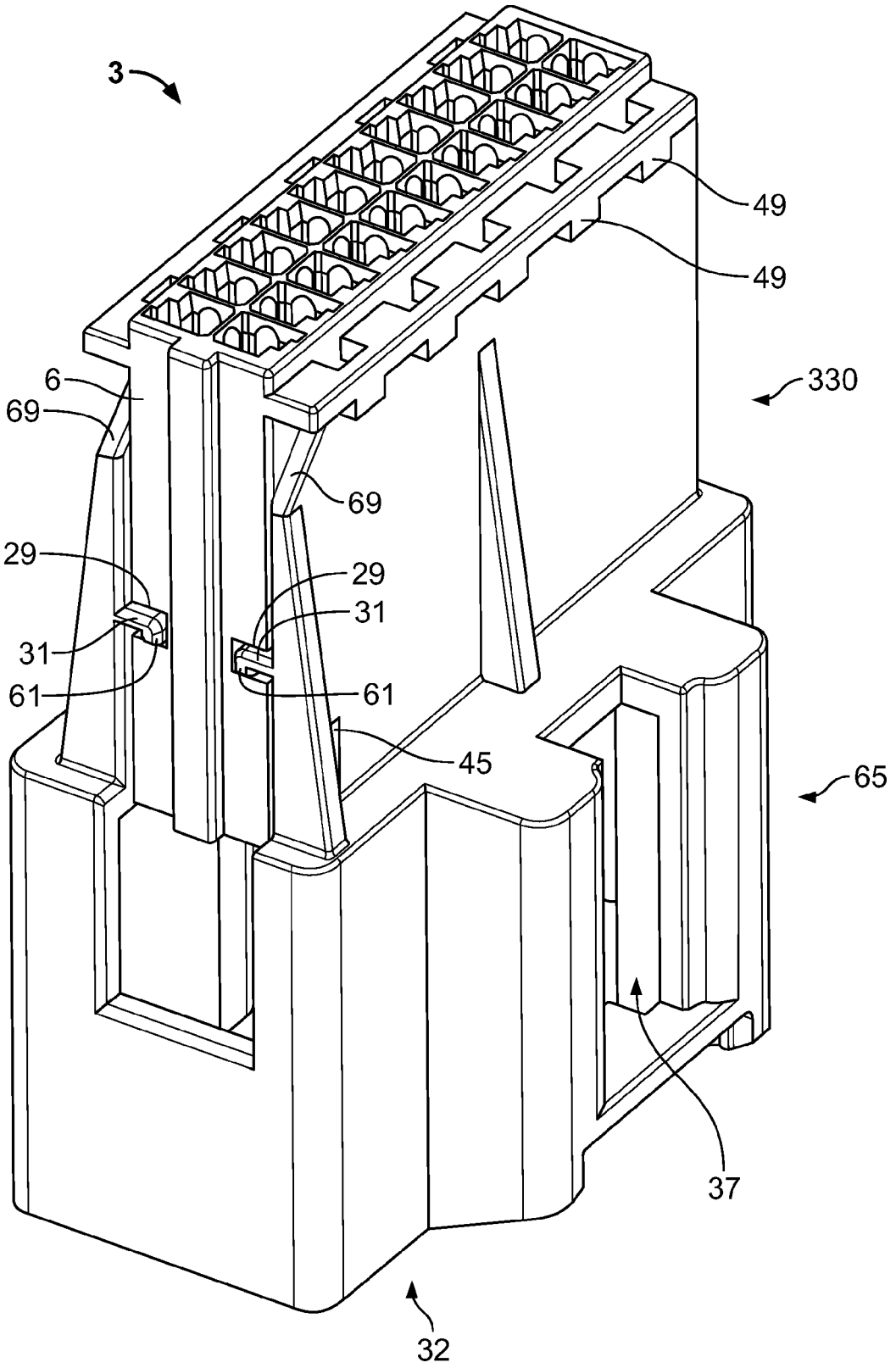
FIG. 7 shows a 3D representation of the second module in the assembled state.

FIG. 6 shows an exploded drawing of a second module 3 of the plug-in module system, and FIG. 7 shows a 3D representation of the second module 3 in the assembled state. The module 3 comprises a first connector casing 32 and a fourth contact casing 6 for a plurality of plug contacts 13. Alternatively, it is however conceivable for socket contacts 12, as shown in FIG. 5, to be introduced into the fourth contact casing 6. The second receptacles 8 of the fourth contact casing 7 are arranged running parallel next to each other in a double row. The second receptacles 8 in this case are identical to the first receptacles 14 for the socket contacts 12 which are shown in FIG. 1 and FIG. 3. The first connector casing 32 comprises an integrated second casing holder 330, which is arranged in an upper region of the second connector casing 32 for fastening the fourth contact casing 6. The first casing holder 330 has a third receptacle 57 into which the fourth contact casing 6 is inserted on the left-hand side. The third receptacle 57 comprises two protrusions 31 arranged opposite each other. The protrusions 31 are provided for engaging in the grooves 29 of the fourth contact casing 6. In such case, the protrusions 31 are designed like the fastening hooks 60 shown in FIG. 3, and have the hook 61 which is provided for engaging behind the limiting bar 62 which is arranged on the groove 29. Further, the first connector casing 32 has two opposing latch receptacles 45 arranged on the left-hand side.

The upper corners on the left-hand side which face the fourth contact casing 6 are slanted by inclines 69. A base region 65 which is located beneath the second casing holder 330 is provided for receiving the first module 2. In this region, the first connector casing 32 comprises a second latch receptacle 37 for receiving the latch spring 35 of the first casing holder 33 which is shown in FIG. 4 and FIG. 5.

To assemble the fourth contact casing 6 in the first connector casing 32, the fourth contact casing 6 is inserted from the left into the third receptacle 57 of the first connector casing 32 in the direction of the arrow. In so doing, the protrusions 31 engage in the grooves 29 of the fourth contact casing 6 and thus ensure that upon insertion of a further contact casing into the first connector casing 32 the fourth contact casing 6 cannot be displaced in the direction of the second receptacle 8. If the fastening position of the fourth contact casing 6 is reached, the latch projections 51 latch in the latch receptacles 45. In this manner, unintentional detachment of the fourth contact casing 6 from the first connector casing 32 is avoided. The bars 49, upon pushing-on, engage around the second casing part 330, the inclines 69 facilitating the pushing onto the second casing part 330. This reliably connects the fourth contact casing 6 to the first connector casing 32 to form the second module 3 of the plug-in module system.

Figure 8:
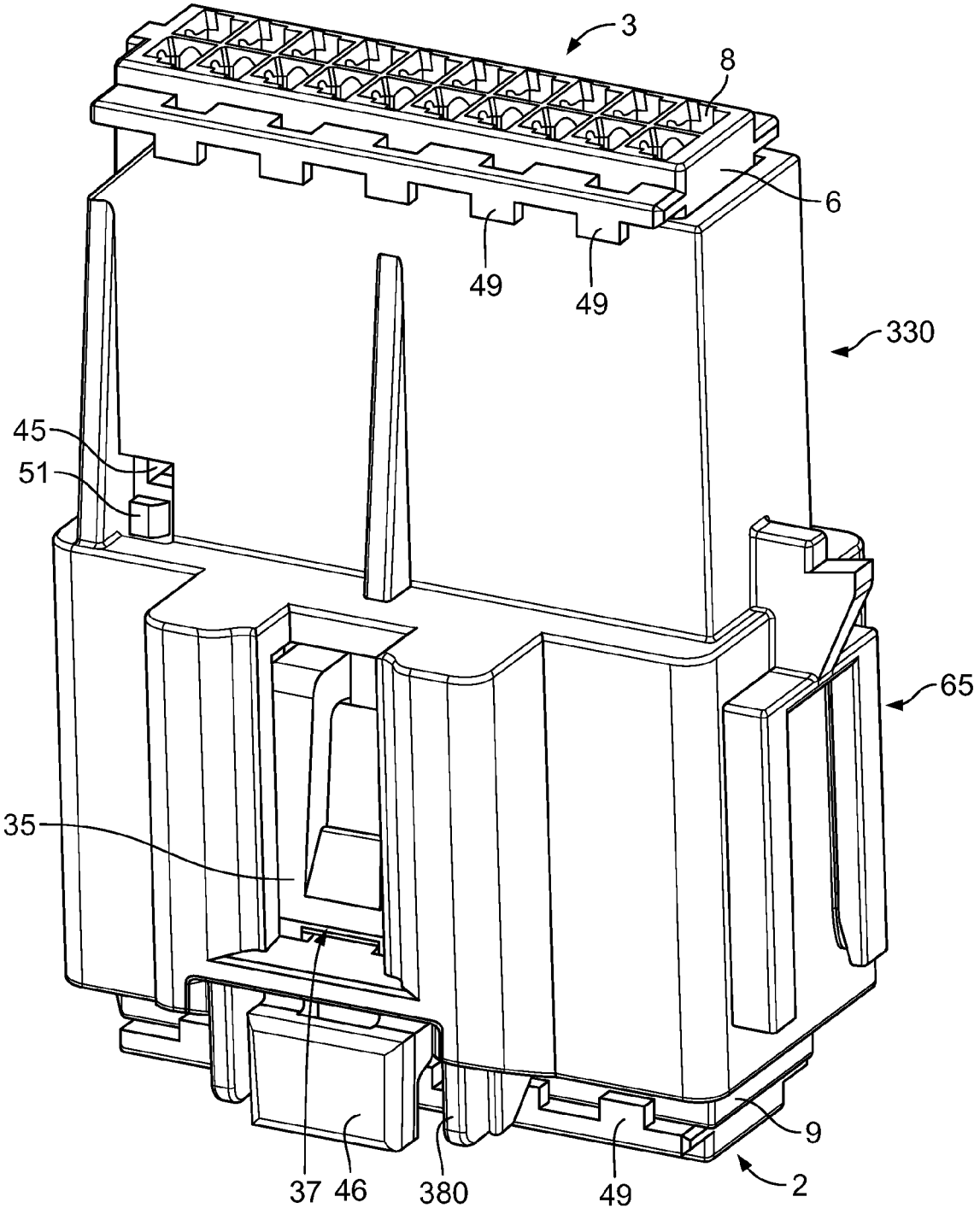
FIG. 8 shows the second module in the assembled state.

FIG. 8 shows a 3D representation of the first and the second module 2, 3 of the plug-in module system. In this case, the first module 2 is fastened to the first connector casing 32 of the second module 3. The fastening of the first module 2 takes place by means of the latch spring 35 of the first casing holder 33, which engages in the second latch receptacle 37. The introduction of the first casing holder 33 takes place from below and is facilitated by the coding ribs 38 arranged on the periphery on the first casing holder 33. If the first casing holder 33 is introduced into the first connector casing 32, an electrical connection between the individual plug contacts 13 and socket contacts 12 is produced.

The third contact casing 6 and the fourth contact casing 9 in this case have not only identical receptacles 8, 14, but are completely identically formed in their configuration. This has the advantage that the contact casings 6, 9 for the plug-in module system can be used both for the socket contact 12 and for the plug contact 13. This permits cheaper production of the plug-in module system, since it is possible to dispense with the production of a separate socket casing or connector casing.

Figure 9:
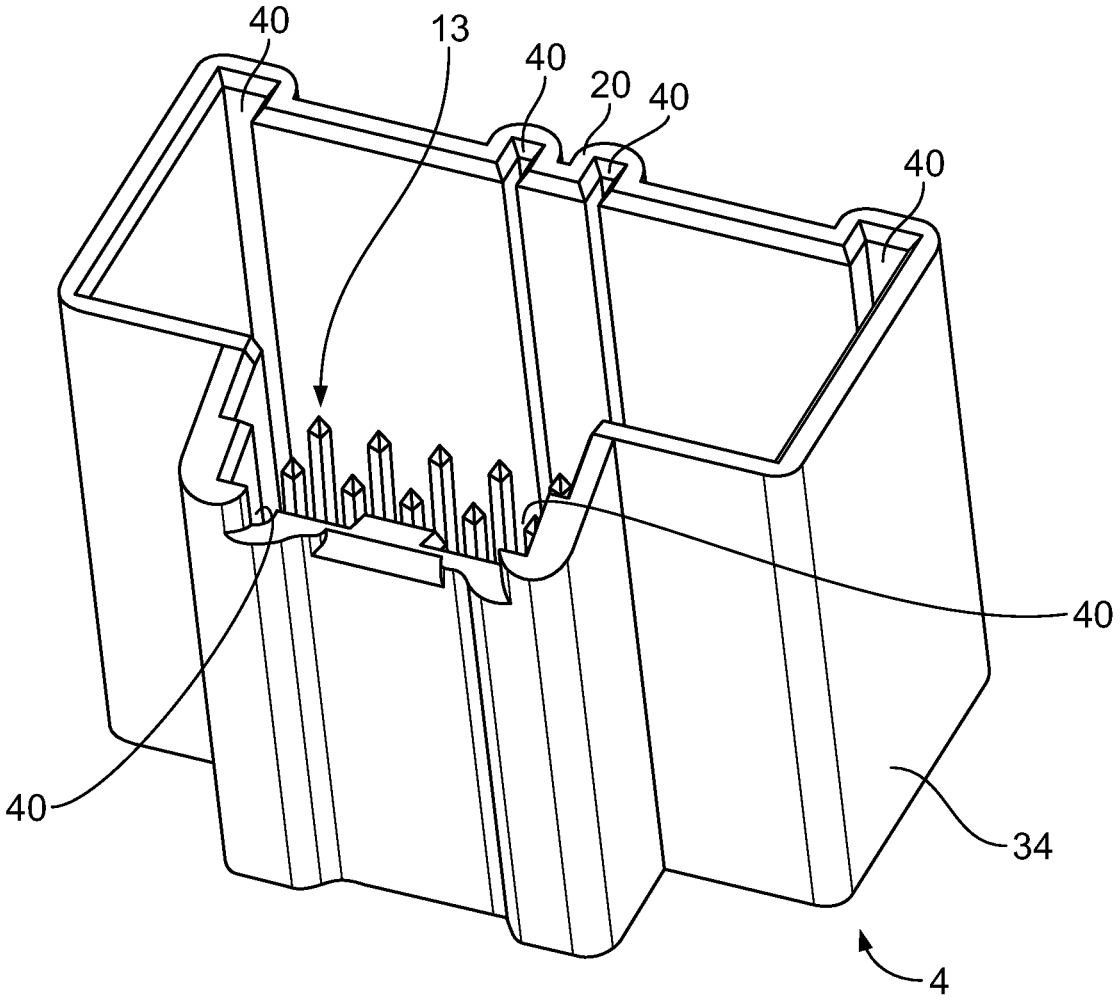
FIG. 9 shows a 3D representation of a third module.

FIG. 9 shows a 3D representation of a third module 4. The third module 4 comprises the connector casing 34, which has a plurality of plug contacts 12 arranged on the underside, which project into an interior of the second connector casing 34. The second connector casing 34 is T-shaped. Internal coding receptacles 40 are arranged on a rear side of the second connector casing 34. Likewise two coding receptacles 40 are arranged internally on a front side. The front region of the third module 4 in this case is designed to receive the latch spring 35 shown in FIG. 4 with the flanking coding ribs 38, in order to fix the first casing holder 33 in the second connector casing 34.

Figure 10:
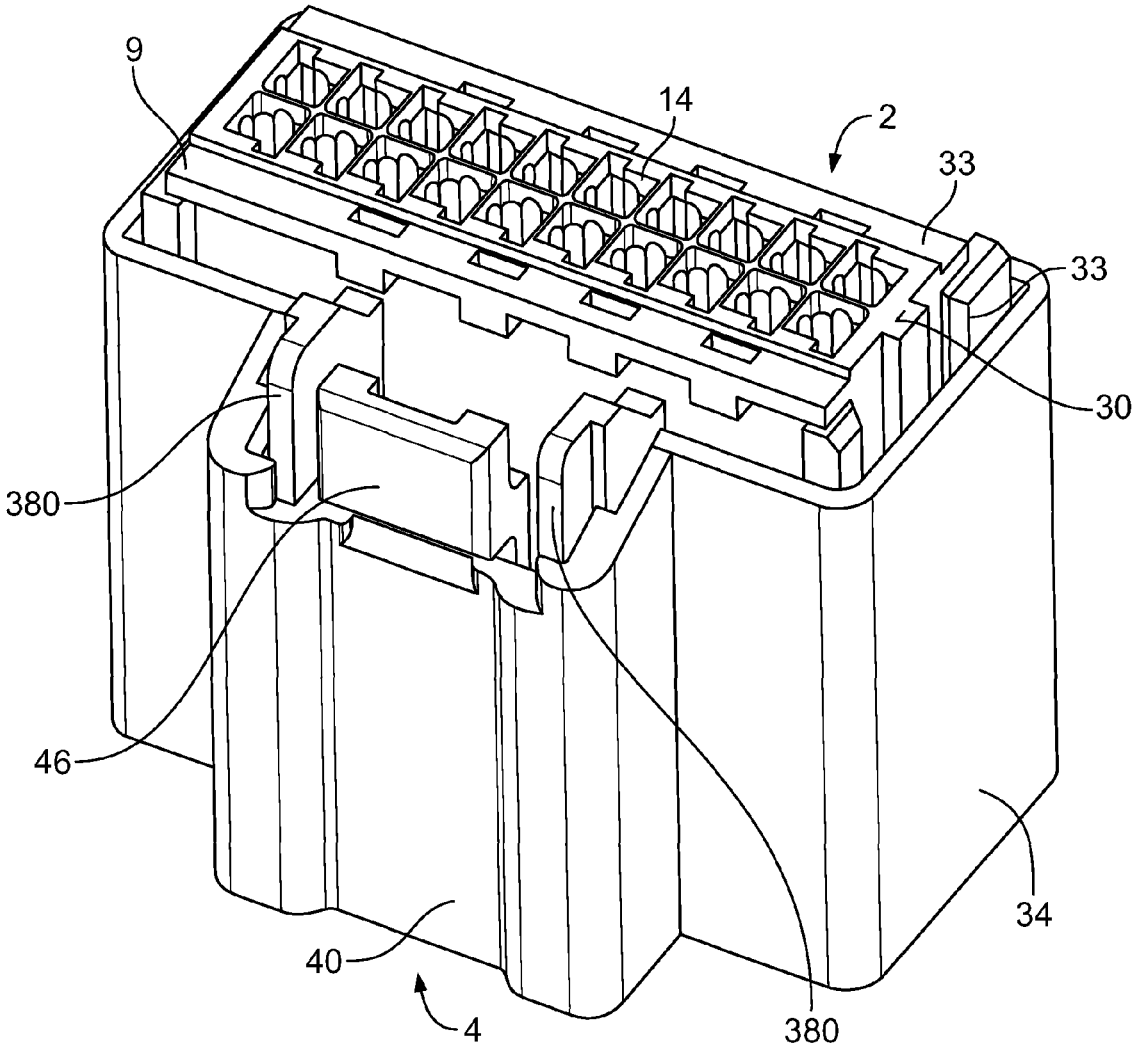
FIG. 10 shows a 3D representation of the third module in the assembled state.

FIG. 10 shows a 3D representation of the first and third module 2, 4 in the assembled state. In this case, the first casing holder 33 is arranged with the third contact casing 9 in the second connector casing 34. The first casing holder 33, together with the third contact casing 9, is fastened reliably in the second connector casing 34 by the latch spring 35. Pulling-out of the third contact casing 9 from the first casing holder 33 is reliably prevented by the tongue-and-groove connection 29, 31 between the first casing holder 33 and the third contact casing 9. The insertion of the first casing holder 33 into the first connector casing 34 is facilitated by specifying the position of the first casing holder 33 by means of the coding ribs 38. The third module 4 is suitable in particular for joining the first module to a device, for example a control unit on a motor vehicle, reliably, simply and reversibly.

Figure 11:
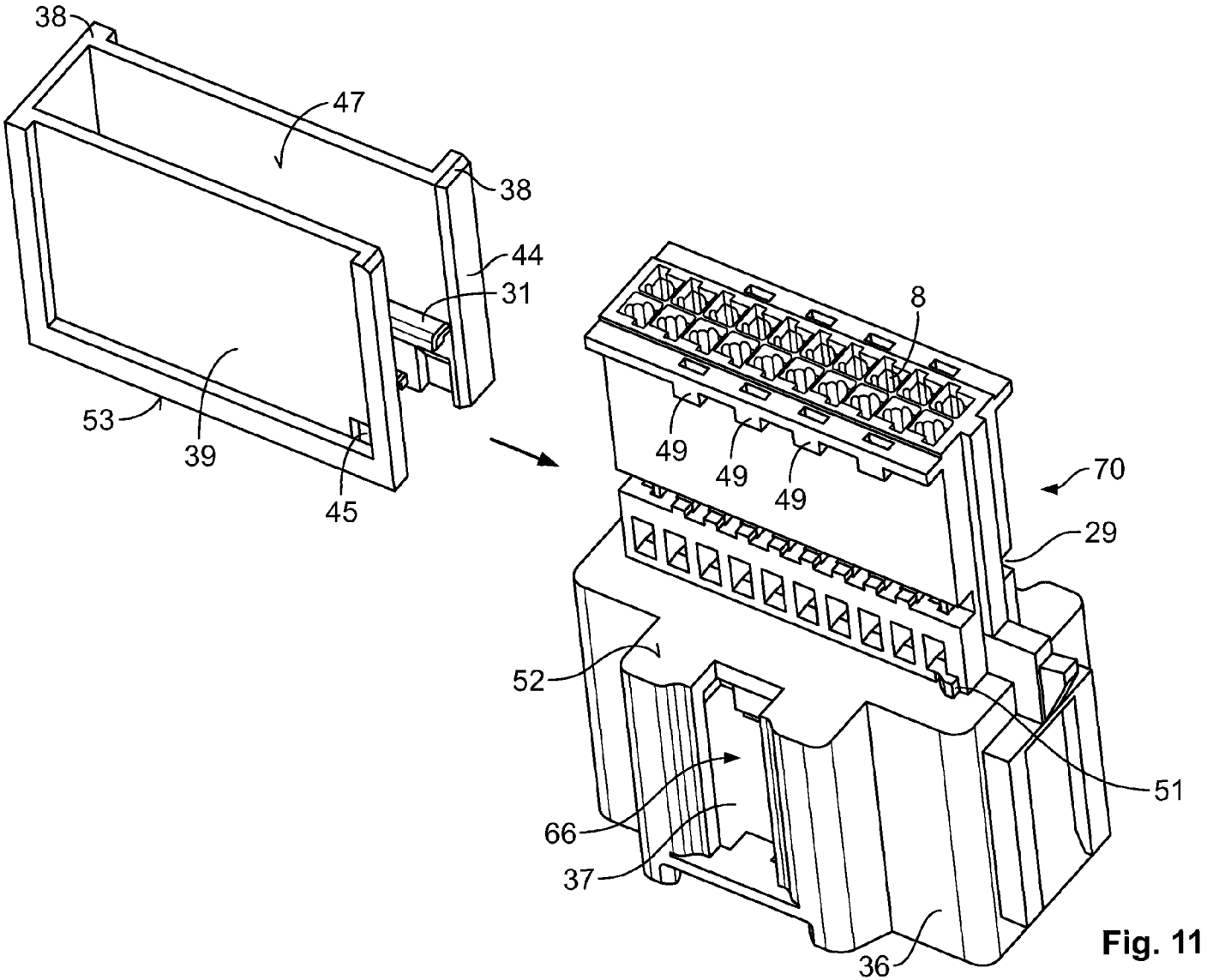
FIG. 11 shows an exploded view of a fourth module.

FIG. 11 shows an exploded view of a fourth module 5. The fourth module 5 comprises a third connector casing 36 and a third casing holder 39. The third casing holder 39 is formed similarly to the first casing holder 33. However, it does not have the latch spring or coding ribs. The third casing holder 39 in this case is likewise U-shaped and has on its third inner surface 47 protrusions 31 with hooks 61 which extend parallel to the end face 30 of the fourth contact casing 6.

The third connector casing 36 is made in one piece and comprises a fifth contact casing 70. The fifth contact casing 70 is integrated in an upper region of the third connector casing 36. Further, the third connector casing 36 comprises a third receptacle 66 in the lower region. The fifth integrated contact casing 70 further has latch projections 51 which are arranged on an upper side 52 of the third connector casing 36. The third receptacle 66 of the third connector casing 36 further comprises the second latch receptacle 37 and is formed similarly to the second connector casing 34.

To assemble the fourth module 5, the third casing holder 39 is pushed on to the third connector casing 36 in the direction of the arrow, so that the recesses 31 [sic] engage in the grooves 29 of the fourth contact casing 6. The third casing holder 39 is fastened on the third connector casing 36 by means of the arranged latch projections 51. These engage in the first latch receptacles 45 in the fastening position of the third casing holder 39. Further, the bars 49 engage around the third casing holder 39, so that the latter is fastened reliably to the third connector casing 36. In this manner, the first recesses 16 are protected from the penetration of dirt and the latch arms 15 arranged therein are protected from damage. Likewise, the third casing holder 39 serves for checking whether the socket contacts 12 or the plug contacts 13 are inserted reliably into the first receptacle 14, since otherwise pushing of the third casing holder 39 on to the third connector casing 36 is prevented by blocking the third casing holder 39 upon pushing-on.

Figure 12:
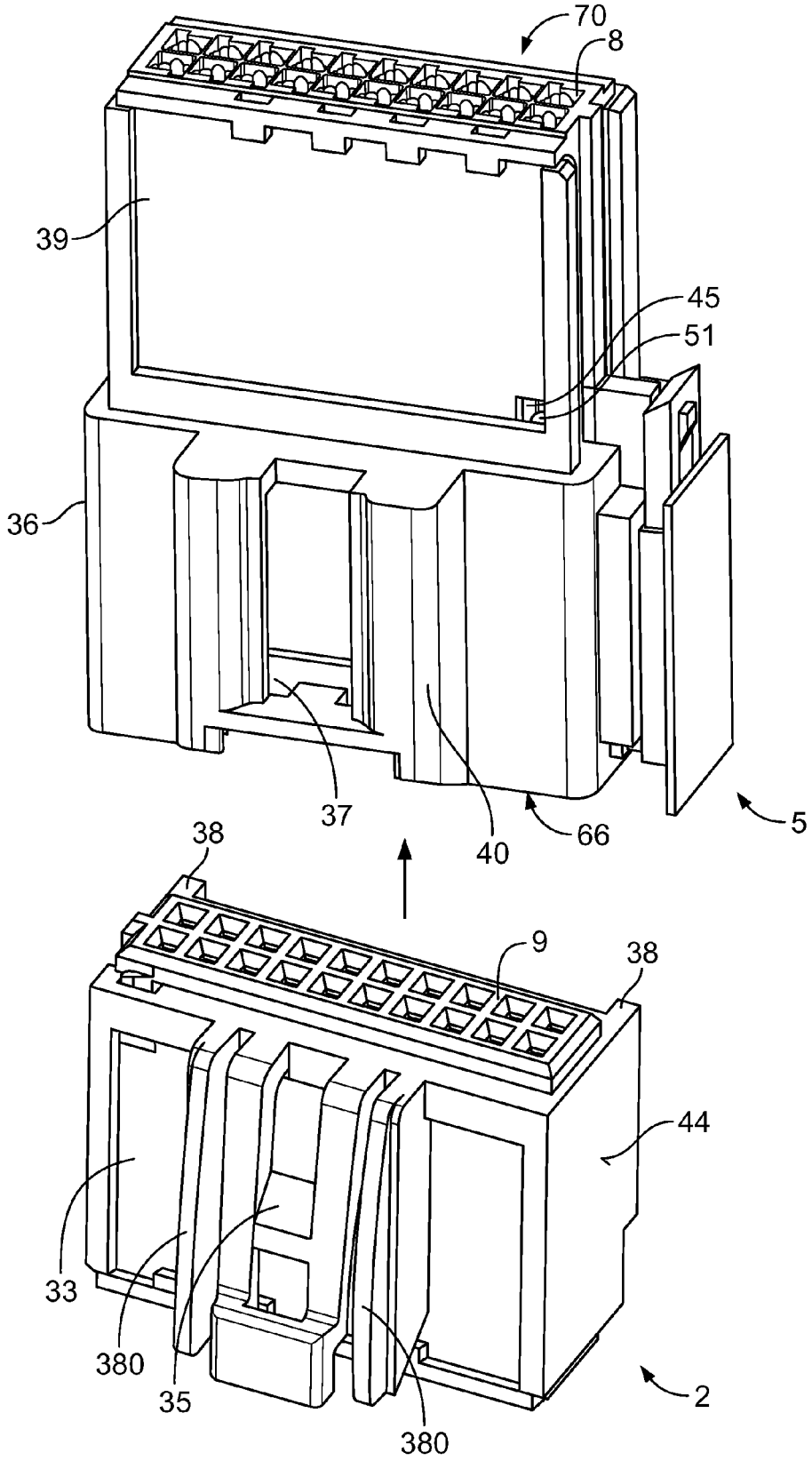
FIG. 12 shows a 3D representation of the first and fourth module in the partially assembled state.

FIG. 12 shows a 3D representation of the second and fourth module 5 in the partially assembled state. The first module 2 shown in FIG. 4 is inserted into the fourth module 5 in the direction of the arrow from below. In so doing, the first casing holder 33 of the first module is guided by the coding ribs 38, so that pins (not shown) of the fourth module 5 reliably engage in the associated female contacts of the third contact casing 6. The locking of the first casing holder 33 takes place by means of the latch spring 35, which engages in the first latch receptacle 37 in the assembled state and locks the first casing holder 33 in the fourth module 5.

The invention claimed is:

1. A plug-in connector having a first contact casing with a first receptacle and a second contact casing with a second receptacle, the first receptacle receiving a socket contact and the second receptacle receiving a plug contact, wherein the first receptacle and the second receptacle are formed identically;

wherein the receptacles in each case have an opening, the opening having a funnel-shaped region which is oriented on the inside towards the socket contact or towards the plug contact, and wherein a sleeve of the socket contact or of the plug contact has a conical region which is associated with the funnel-shaped region.

2. A plug-in connector according to claim 1, wherein the first and second receptacles each have a recess which is provided to receive a latch arm of the corresponding socket contact and plug contact.

3. A plug-in connector according to claim 1, wherein the opening has a further funnel-shaped region on the outside on the contact casing.

4. A plug-in connector according to claim 1, wherein the first contact casing and the second contact casing are formed substantially identically.

5. A plug-in connector according to claim 1, wherein one of the contact casings has on an outer peripheral surface at least one first groove which is designed to receive a protrusion of a casing holder.

6. A plug-in connector according to claim 5, wherein the casing holder engages at least partially around the first or the second contact casing, and the casing holder is designed to connect the first or the second contact casing to a connector casing.

7. A plug-in connector according to claim 6, wherein the casing holder has a latching means on a periphery designed to engage in a latch receptacle of the connector casing.

8. A plug-in connector according to claim 6, wherein the casing holder has a coding rib which is designed to engage in a coding recess of the connector casing.

9. A plug-in module system with a plug-in connector in particular according to claim 1 and a first casing holder, the first casing holder being connected to the first contact casing of the plug-in connector, wherein the first casing holder is designed to fasten the first contact casing to a connector casing and means are provided for fastening the second contact casing to the connector casing.

10. A plug-in module system according to claim 9, wherein the casing holder partially encompasses the contact casing, and the contact casing being connected to the casing holder by means of a connection.

11. A plug-in module system according to claim 10, wherein the connection or the means comprise one from a group including a tongue-and-groove connection and at least one compression rib and a latching means.

12. A plug-in module system according to claim 9, wherein the first casing holder has on a periphery a latch spring which is designed to engage in a recess of the connector casing and to connect the casing holder to the connector casing.

13. A plug-in module system according to claim 9, wherein the casing holder has at least one coding rib which engages in a coding recess of the connector casing and specifies the orientation of the casing holder relative to the connector casing.

14. A plug-in module system according to claim 9, wherein the first contact casing is formed identically to a second contact casing.

15. A plug-in connector having a first contact casing with a first receptacle and a second contact casing with a second receptacle, the first receptacle being designed to receive a socket contact and the second receptacle being designed to receive receiving a plug contact, wherein the first receptacle and the second receptacle are formed identically, wherein the contact casing has on an outer peripheral surface at least one first groove which is designed to receive a protrusion of a casing holder.

16. A plug-in connector according to claim 15, wherein the casing holder engages at least partially around the first or the second contact casing, and the casing holder is designed to connect the first or the second contact casing to a connector casing.

17. A plug-in connector according to claim 16, wherein the casing holder has a latching means on its periphery which is designed to engage in a latch receptacle of the connector casing.

18. A plug-in connector according to claim 16, wherein the casing holder has a coding rib which is designed to engage in a coding recess of the connector casing.

19. A plug-in module system, comprising:

a plug-in connector having a first contact casing with a first receptacle and a second contact casing with a second receptacle, the first receptacle being designed to receive a socket contact and the second receptacle being designed to receive a plug contact, wherein the first receptacle and the second receptacle are formed identically, and;

a first casing holder, the first casing holder being connected to the first contact casing of the plug-in connector, wherein the first casing holder is designed to fasten the first contact casing to a connector casing and means are provided for fastening the second contact casing to the connector casing.

20. A plug-in module system according to claim 19, wherein the casing holder partially encompasses the contact casing, and the contact casing being connected to the casing holder by means of a connection.

21. A plug-in module system according to claim 19, wherein the connection and/or the means have a tongue-and-groove connection and/or at least one compression rib and/or a latching means.

22. A plug-in module system according to claim 19, wherein the first casing holder has on its periphery a latch spring which is designed to engage in a recess of the connector casing and to connect the casing holder to the connector casing.

23. A plug-in module system according to claim 19, wherein the casing holder has at least one coding rib which engages in a coding recess of the connector casing and specifies the orientation of the casing holder relative to the connector casing.

24. A plug-in module system according to claim 19, wherein the first contact casing is formed identically to the second contact casing.

* * * * *